US007582989B2

(12) United States Patent
Burr et al.

(10) Patent No.: US 7,582,989 B2
(45) Date of Patent: Sep. 1, 2009

(54) SAFETY RELAY HAVING INDEPENDENTLY TESTABLE CONTACTS

(75) Inventors: Kent Allan Burr, Round Rock, TX (US); Gary Keith Law, Georgetown, TX (US)

(73) Assignee: Fisher-Rosemount Systems, Inc., Austin, TX (US)

( * ) Notice: Subject to any disclaimer, the term of this patent is extended or adjusted under 35 U.S.C. 154(b) by 250 days.

(21) Appl. No.: 11/537,005

(22) Filed: Sep. 29, 2006

(65) Prior Publication Data

US 2008/0079318 A1 Apr. 3, 2008

(51) Int. Cl.

| | |
|---|---|
| ***H01H 31/00*** | (2006.01) |
| ***H01H 33/59*** | (2006.01) |
| ***H01H 47/00*** | (2006.01) |
| ***H01H 85/46*** | (2006.01) |
| ***H01H 19/14*** | (2006.01) |

(52) U.S. Cl. ..... 307/115

(58) Field of Classification Search ..... 307/115, 307/143, 141.8, 137, 139, 142; 324/415, 324/418, 420, 421

See application file for complete search history.

(56) References Cited

U.S. PATENT DOCUMENTS 7,242,196 B2 * 7/2007 Yudahira et al. ..... 324/420

2001/0002101 A1 5/2001 Magnussen

FOREIGN PATENT DOCUMENTS

DE 102006030911 9/2007

OTHER PUBLICATIONS

UK Intellectual Property Office, Patents Act 1077: Search Report under Section 17, Jan. 29, 2008, 1 page.

HIMA TUV Industrie Service GMBH, "H 4135: Relay in an electronic housing", Apr. 14, 2004, 4 pages.

* cited by examiner

*Primary Examiner*—Albert W Paladini
*Assistant Examiner*—Carlos Amaya
(74) *Attorney, Agent, or Firm*—Hanley, Flight & Zimmerman, LLC

(57) ABSTRACT

Methods, apparatus, and articles of manufacture related to safety relays having independently testable relay contacts are disclosed. In one disclosed example, a safety relay includes a plurality of relay coils, each of which is coupled in parallel to a first node via a respective one of a plurality of switches. The disclosed example also includes and a plurality of relay contacts, each of which corresponds to a respective one of the plurality of relay coils. The relay contacts of the safety relay are coupled in series and independently controllable by respective ones of the switches.

27 Claims, 7 Drawing Sheets

SAFETY RELAY HAVING INDEPENDENTLY TESTABLE CONTACTS

TECHNICAL FIELD

This present disclosure relates generally to safety relays for use in process control systems and, more specifically, a safety relay having independently testable contacts.

BACKGROUND

Process control systems, like those used in chemical, petroleum or other processes, typically include one or more centralized process controllers communicatively coupled to at least one host or operator workstation and to one or more field devices or relays via analog, digital or combined analog/digital buses. The field devices, which may be, for example, valves, valve positioners, switches, and transmitters (e.g., temperature, pressure, and flow rate sensors), perform functions within the process such as opening or closing valves and measuring process parameters. The relays, which may be solid-state relays, mechanical relays, protection relays, overcurrent relays, safety relays, etc., perform functions within the process to replicate a signal, open and/or close mechanical actuators, valves, and/or switches to selectively convey power and/or other signals to field devices, etc. The process controllers receive signals indicative of process measurements made by the field devices, relays, and/or other information pertaining to the field devices and relays, use this information to implement one or more control routines, and then generate control signals that are sent over the busses or other communication lines to the field devices and/or relays to control the operation of the process. Information from the field devices, relays, and the controllers may be made available to one or more applications executed by the operator workstation to enable an operator to perform desired functions with respect to the process, such as viewing the current state of the process, modifying the operation of the process, testing the operation of the process, etc.

Some process control systems or portions thereof may present significant safety risks. For example, chemical processing plants, power plants, etc. may implement critical processes that, if not properly controlled and/or shut down rapidly using a predetermined shut down sequence, could result in significant damage to people, the environment, and/or equipment. To address the safety risks associated with process control systems having such critical processes, many process control system providers offer products compliant with safety-related standards such as, for example, the International Electrotechnical Commission (IEC) 61508 standard and the IEC 61511 standard.

In general, process control systems that are compliant with one or more known safety-related standards are implemented using a safety instrumented system architecture in which the controllers, relays, and field devices associated with the basic process control system, which is responsible for the continuous control of the overall process, are physically and logically separate from special purpose field devices and other special purpose control elements associated with the safety instrumented system, which is responsible for the performance of safety instrumented functions to ensure the safe shutdown of the process in response to control conditions that present a significant safety risk. In particular, compliance with many known safety-related standards requires a basic process control system to be supplemented with special purpose control elements such as logic solvers, safety certified field devices (e.g., sensors, safety relays, final control elements such as, for example, pneumatically actuated valves), and safety certified software or code (e.g., certified applications, function modules, function blocks, etc.)

As previously discussed, safety instrumented systems may include safety relays, which may require a relatively high degree of diagnostic coverage and fault tolerance. For example, a hardware device fault tolerance of two implies that two components of the device could fail and the function would still be performed by the device. From these requirements, safety relays have been developed that provide multiple switching elements to break an electrical path between, for example, a power source or other signal source and a field device. Generally, these safety relays use multiple force-guided relays that have mechanically linked relay contacts. As a result, the relay contacts move together when one or more relay coils are energized or de-energized. However, such force-guided relays are expensive to maintain and operate because such relays must be physically removed from the process to test the operation of the relays. Similarly, if a fault exists on the relay, such as one or more inoperable contacts (e.g., one or more welded contacts), the process must shutdown to replace the faulted relay.

SUMMARY

In accordance with one aspect, a process control system, which may control a plurality of field devices, includes an example relay module configured as a safety relay that has independently testable relay contacts. More particularly, an example safety relay is configured with a plurality of relay coils coupled in parallel and a plurality of series coupled relay contacts associated with the relay coils, wherein the operation of each of the relay contacts is testable in response to a signal applied to the relay coils.

In accordance with another aspect, an example safety relay includes a plurality of relay coils, a plurality of switches, and a plurality of relay contacts. More particularly, the relay contacts are connected in series and the relay coils are connected in parallel such that each relay contact is independently controllable by its respective one of the switches.

In accordance with still another aspect, an example method to test a safety relay such as, for example, the example safety relays having independently testable contacts is described. The example method provides a process to open a switch on the example safety relays to independently control a respective one of a plurality relay contacts and to test an electric potential associated with the plurality of relay contacts. The electric potential identifies the operability or inoperability of the relay contact controlled by the switch to determine, for example, if the relay contact is welded.

DETAILED DESCRIPTION

In general, the apparatus and methods described herein relate to safety relays that may be used, for example, within a process control system and, in particular, a safety instrumented process control system to provide a redundant, testable, and fault-tolerant system. More specifically, in one example implementation a safety relay having independently testable contacts is disclosed. The example safety relay is configured with a plurality of relay coils coupled in parallel and a plurality of series coupled relay contacts associated with the relay coils, wherein the operation of each of the relay contacts is testable in response to a signal applied to the relay coils. In the instance of one or more inoperable relay contacts (e.g., welded contacts), the signal may identify the respective faulted relay contacts based on a measured electrical characteristic (e.g., an electric potential, an electric current, etc) of the relay contacts.

In another example implementation described herein, a safety relay is configured to enable a safety relay to be tested while one or more field devices, which may be controlled by the safety relay, remain operable from a power source during the testing. More particularly, the example safety relay includes a bypass switch to provide an alternative electrical path between the power source and the field devices.

In another aspect, an example method to test safety relays is described. The example method provides a process to open a switch on the example safety relays to independently control a respective one of a plurality relay contacts and to measure an electrical characteristic (e.g., an electric potential, an electric current, etc.) of the plurality of relay contacts. The electrical characteristic identifies the operability or inoperability of the relay contact controlled by the switch to determine, for example, if the relay contact is welded.

Thus, in contrast to known safety relays, the safety relays described herein enable a human operator, an electronic controller, and/or any programmable device to test the operability of the safety relays. Consequently and in comparison to known safety relays, the example safety relays described herein provide a high-degree of testability to further enhance safety. Also, the example safety relays described herein may enable field devices and process control systems to operate continuously during such testing and, therefore, the operational impacts to the field devices and process control systems are significantly reduced. Accordingly, the testing of the example safety relays described herein may not require outages or other such termination of the operations of field devices and/or process control systems, which may entail significant production costs and time. For instance, the testing of the example safety relays and, thus, the safety of field devices and/or process control systems can become more frequent since because such testing may not involve operation stoppages.

Figure 1:
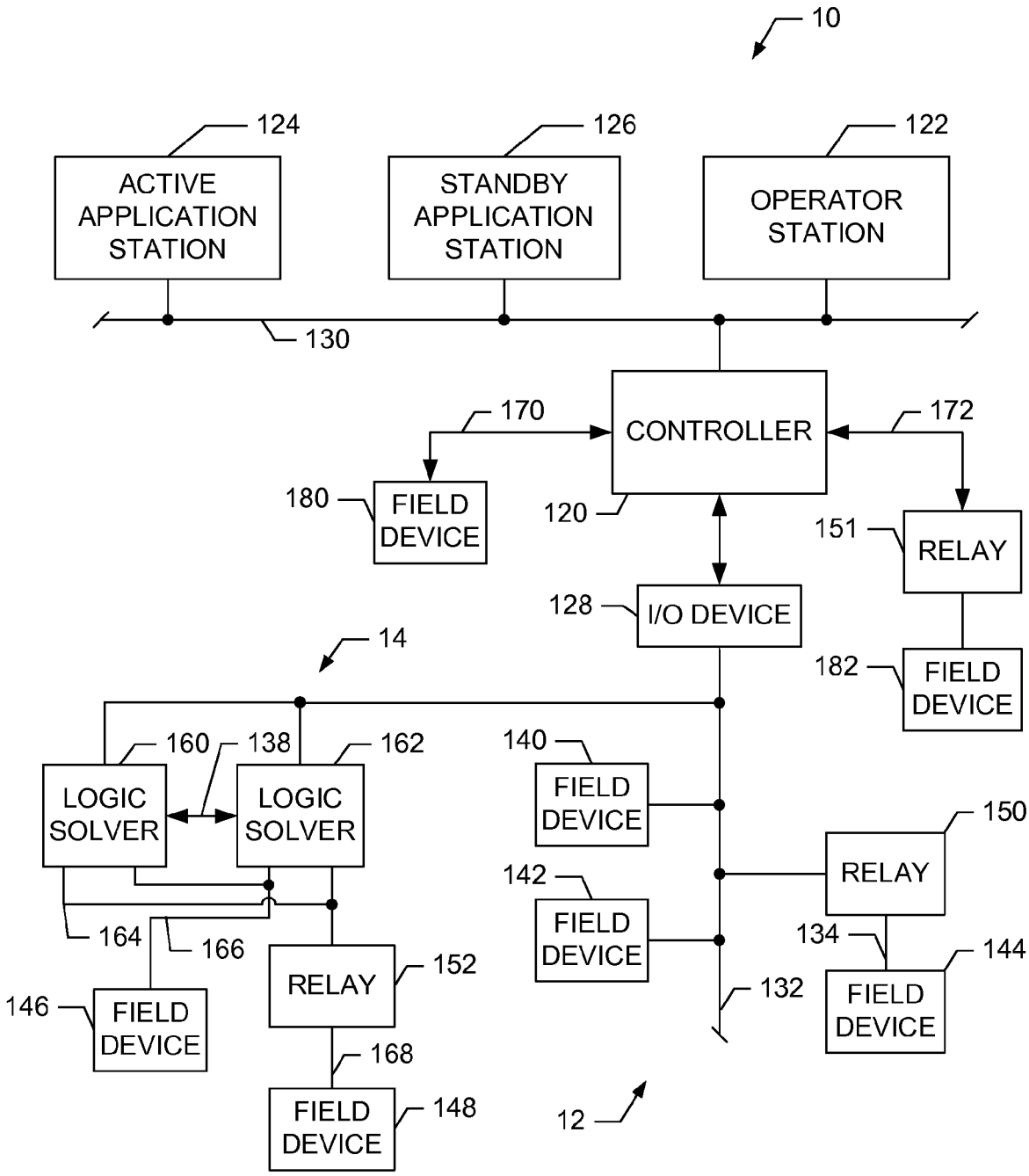
FIG. 1 is a block diagram of an example process control system that may use the example safety relays described herein.

FIG. 1 is a block diagram of an example process control system 10 that uses the example safety relay apparatus, methods, and articles of manufacture described herein. As shown in FIG. 1, the process control system 10 includes a basic process control system portion 12 and a safety instrumented portion 14. The basic process control system portion 12 is responsible for continuous performance of a controlled process, whereas the safety instrumented portion 14 is responsible for carrying out a shut down of the controlled process in response to one or more unsafe conditions. As depicted in FIG. 1, the basic process control system portion 12 includes a controller 120, an operator station 122, an active application station 124 and a standby application station 126, all of which may be communicatively coupled via a bus or local area network (LAN) 130, which is commonly referred to as an application control network (ACN). The operator station 122 and the application stations 124 and 126 may be implemented using one or more workstations or any other suitable computer systems or processing units. For example, the application stations 124 and 126 could be implemented using personal computers similar to the example processor system 1200 shown in FIG. 12 below, single or multi-processor workstations, etc. In addition, the LAN 130 may be implemented using any desired communication protocol and medium, including hardwired or wireless communication links. For example, the LAN 130 may be based on a hardwired or wireless Ethernet communication scheme, which is well known and, thus, is not described in greater detail herein. However, as will be readily appreciated by those having ordinary skill in the art, any other suitable communication medium and protocol could be used. Further, although a single LAN is shown, more than one LAN and appropriate communication hardware within the application stations 124 and 126 may be used to provide redundant communication paths between the operator station 122, the application stations 124 and 126, and the controller 120.

The controller 120 may be coupled to a plurality of smart field devices 140 and 142 via a digital data bus 132 and an input/output (I/O) device 128. The I/O device 128 provides one or more interfaces for the controller 120 and any other device coupled to the digital data bus 132 (e.g., the smart field devices 140 and 142, the relay module 150, etc.) to collectively communicate with signals sent and received through those interfaces. For example, the I/O device 128 may be implemented by any type of current or future standard interface, such as an external memory interface, serial port, general purpose input/output, or any type of current or future communication device, such as a modem, network interface card, etc. The digital data bus 132 may be any physical arrangement that provides logical communications functionality, such as, for example, parallel electrical buses with multiple connections, bit-serial connections, both parallel and bit-serial connections, switched hub connections, a multidrop topology, a daisy chain topology, etc. The smart field devices 140 and 142 may be Fieldbus compliant valves, actuators, sensors, etc., in which case the smart field devices 140 and 142 communicate via the digital data bus 132 using the well-known Fieldbus protocol. Of course, other types of smart field devices and communication protocols could be used instead. For example, the smart field devices 140 and 142 could instead be Profibus or HART compliant devices that communicate via the data bus 132 using the well-known Profibus and HART communication protocols. Additional I/O devices (similar or identical to the I/O device 128) may be coupled to the controller 120 to enable additional groups of smart field devices, which may be Fieldbus devices, HART devices, etc., to communicate with the controller 120.

In addition to the smart field devices 140 and 142, the controller 120 may be coupled to a relay module 150 via the digital data bus 132. The relay module 150 may respond to signals sent from the controller 120 via the data bus 132. For example, the relay module 150 may respond to a signal from the controller 120 and subsequently open and/or close one or more switches on the relay module 150. In the discussion herein, a relay module may comprise one or more relays that provide one or more electrical switches to open and/or close, not necessarily simultaneously, in response to an electrical signal. The components of the relay or relay modules may include solid-state electronic component(s) and/or electromechanical component(s) to provide this functionality. Additionally, the controller 120 may obtain the value of an electrical characteristic such as, for example, an electric potential, an electric current, a resistance, etc. of the relay contacts on the relay module 150 via the digital data bus 132.

The relay module 150 may be coupled to a non-smart field device 144 via a hardwired link 134, which may respond to a signal transmitted from the relay module 150 in response to a signal received at the relay module 150 from the controller 120. The non-smart field device 144 may, for example, operate at a high voltage and/or amperage via an alternating or direct current path. The relay module 150 may be electronically coupled to the field device 144 to control the conveyance of power and/or other signals to the field device 144. Thus, in operation, the relay module 150 may be used to apply power to the field device 144, remove power from the field device 144, or apply/remove any other signal to/from the field device 144. Further, although the example relay module 150 is shown coupled to a single non-smart field device (e.g., the non-smart field device 144), the example relay module 150 may be coupled to a plurality of field devices.

In addition to communications via the digital data bus 132, the controller 120 may be coupled to an example relay module 151 and field devices 180 and 182 via hardwired circuits 170 and 172. The hardwired circuits 170 and 172 may implement a digital or combination analog/digital communication protocol (e.g., HART, Fieldbus, etc.) or any analog communication protocol. Similarly, the example relay module 151 and the field devices 180 and 182 may be implemented as field devices implemented with conventional 4-20 milliamp (mA) or 0-10 volts direct current (VDC) circuitry or as field devices implemented with solid-state components.

The controller 120 may be, for example, a DeltaV™ controller sold by Fisher-Rosemount Systems, Inc. and Emerson Process Management™. However, any other controller could be used instead. Further, while only one controller is shown in FIG. 1, additional controllers of any desired type or combination of types could be coupled to the LAN 130. The controller 120 may perform one or more process control routines associated with the process control system 10. Such process control routines may be generated by a system engineer or other human operator using the operator station 122 and downloaded to and instantiated in the controller 120.

As depicted in FIG. 1, the safety instrumented portion 14 of the process control system 10, includes a relay module 152, field devices 146 and 148, and logic solvers 160 and 162. The logic solvers 160 and 162 may, for example, be implemented using the commercially available DeltaV SLS 1508 logic solver produced by Fisher-Rosemount Systems, Inc and Emerson Process Management™. Alternatively, the logic solvers 160 and 162 may be implemented through any logic device such as a programmable logic controller ("PLC") or processor. In general, the logic solvers 160 and 162 cooperate as a redundant pair via a redundancy link 138. However, the redundant logic solvers 160 and 162 could instead be a single non-redundant logic solver or multiple non-redundant logic solvers. Also, generally, the example logic solvers 160 and 162 are safety rated electronic controllers that are configured to implement one or more safety instrumented functions. As is known, a safety instrumented function is responsible for monitoring one or more process conditions associated with a specific hazard or unsafe condition, evaluating the process conditions to determine if a shut down of the process is warranted, and causing one or more final control elements (e.g., shut down valves) to effect a shut down of a process, if warranted.

A safety instrumented function may be implemented using a sensing device, a logic solver, a relay, and/or a final control device (e.g., a valve). The logic solver may be configured to monitor at least one process control parameter via the sensor and, if a hazardous condition is detected, to operate the final control device via the relay to effect a safe shut down of the process. For example, a logic solver (e.g., the logic solver 160) may be communicatively coupled to a pressure sensor (e.g., the field device 146) that senses the pressure in a vessel or tank and may be configured to signal a relay module (e.g., the relay module 152) to cause a vent valve (e.g., the field device 148) to open if an unsafe overpressure condition is detected via the pressure sensor. Of course, each logic solver within a safety instrumented system may be responsible for carrying out one or multiple safety instrumented functions and, thus, may be communicatively coupled to multiple sensors, relay modules, and/or final control devices, all of which are typically safety rated or certified.

As shown in FIG. 1, the field devices 146 and 148, the relay module 152, and the logic solvers 160 and 162, are coupled via links 164, 166, and 168. In the case where the relay module 152 and the field devices 146 and 148 are smart devices, the logic solvers 160 and 162 may communicate using a hardwired digital communication protocol (e.g., HART, Fieldbus, etc.) However, any other desired communication media (e.g., hardwired, wireless, etc.) and protocol(s) may be used instead. As is also shown in FIG. 1, the logic solvers 160 and 162 are communicatively coupled to the controller 120 via the digital data bus 132 and the I/O device 128. However, the logic solvers 160 and 162 could alternatively be communicatively coupled to the system 10 in any other desired manner such as, for example, via a stand-alone safety system that operates independently of the controller 120. For example, the logic solvers 160 and 162 could be coupled directly to the LAN 130. Regardless of the manner in which the logic solvers 160 and 162 are coupled to the system 10, the logic solvers 160 and 162 are preferably, although not necessarily, logical peers with respect to the controller 120.

The relay module 152 may be a safety certified or rated relay module that can be used to effect a controlled shut down of the process control system 10. While the example safety instrumented portion 14 of the process control system 10 is shown with a single relay (e.g., relay module 152), the process control system 10 may be implemented with a plurality of relays or relay modules. Additionally, while the relay module 152 is shown coupled to a single field device (e.g., field device 148), the relay module 152 may instead be coupled to a plurality of field devices. Because the relay module 152 may be a safety certified or rated relay, the logic solvers 160 and 162 and the controller 120 may redundantly communicate with the relay module 152 via links 164-168. The communications between the logic solvers 160 and 162, the controller 120, and the relay module 152 may be implemented to test the fault tolerance of the relay module 152 to insure the fault tolerance of the process control system 10. As described in greater detail below, the controller 120 may, for example, test the relay module 152 by sending signals to open and close switches within the relay module 152 and/or to measure an electrical characteristic associated with a set of relay contacts of the relay module 152.

The field devices 146 and 148 may be smart or non-smart sensors, actuators, and/or any other process control devices that can be used to monitor process conditions and/or effect a controlled shut down of the process control system 10. For example, the field devices 146 and 148 may be safety certified or rated flow sensors, temperature sensors, pressure sensors, shut down valves, venting valves, isolation valves, critical on/off valves, contacts, etc. While only two logic solvers, two field devices, and one safety relay are depicted in the safety instrumented portion 14 of the example process control system 10 of FIG. 1, additional field devices, relays, and/or logic solvers may be used to implement any desired number of safety instrumented functions.

Figure 2:
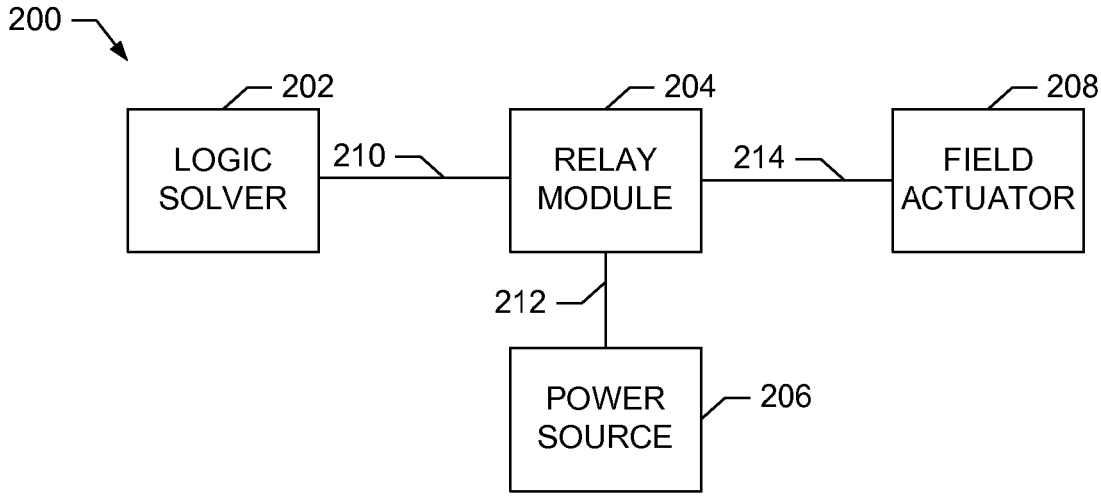
FIG. 2 is a detailed block diagram of a part of the safety instrumented portion of the example process control system of FIG. 1.

FIG. 2 is a detailed block diagram of a part 200 of the safety instrumented portion 14 of the example process control system 10 of FIG. 1. The example system 200 includes a logic solver 202, which may correspond to the logic solver 160 or 162 of FIG. 1, a relay module 204, which may correspond to the example relay module 152 of FIG. 1, a field actuator 208, which may correspond to the example field device 148 of FIG. 1, and a field power source 206 that can supply electrical power to the field actuator 208. The field power source 206 may be an alternating or direct current source. The logic solver 202 may be coupled to the relay module 204 by hardwired connector(s) 210 that may, for example, create a DC circuit between the logic solver 202 and the relay module 204. Also, the relay module 204 may be coupled to the field power source 206 by hardwired connector(s) 212, and to the field actuator 208 by hardwired connector(s) 214. The hardwired connectors 212 and 214 may, for example, create one or more DC and/or AC circuits between the power source 206 and field actuator 208. Further, the connectors 210, 212, and 214 may be implemented as wires, multi-conductor cabling, or any other media suitable to convey electrical signals and/or power.

The example relay module 204 may be configured to connect the field power source 206 to and disconnect the field power source 206 from the field actuator 208 to control the operation of the field actuator 208. For example, when the logic solver 202 signals via the hardwired connector(s) 210, the relay module 204 may disconnect (e.g., to close the field actuator 208) or connect (e.g., to open the field actuator 208) the hardwired connectors 212 and 214 to source or cease supplying current from the power source 206 to the field actuator 208. The logic solver 202 and the relay module 204 are more commonly configured to de-energize-to-trip (i.e., to decrease potential or apply substantially zero potential across the hardwired connector(s) 210 to change the state of the relay module contacts to remove power from the field actuator 208), but may be configured to energize-to-trip (i.e., to increase or apply a substantially non-zero potential across the hardwired connector(s) 210 to change the state of the relay module contacts).

Figure 3:
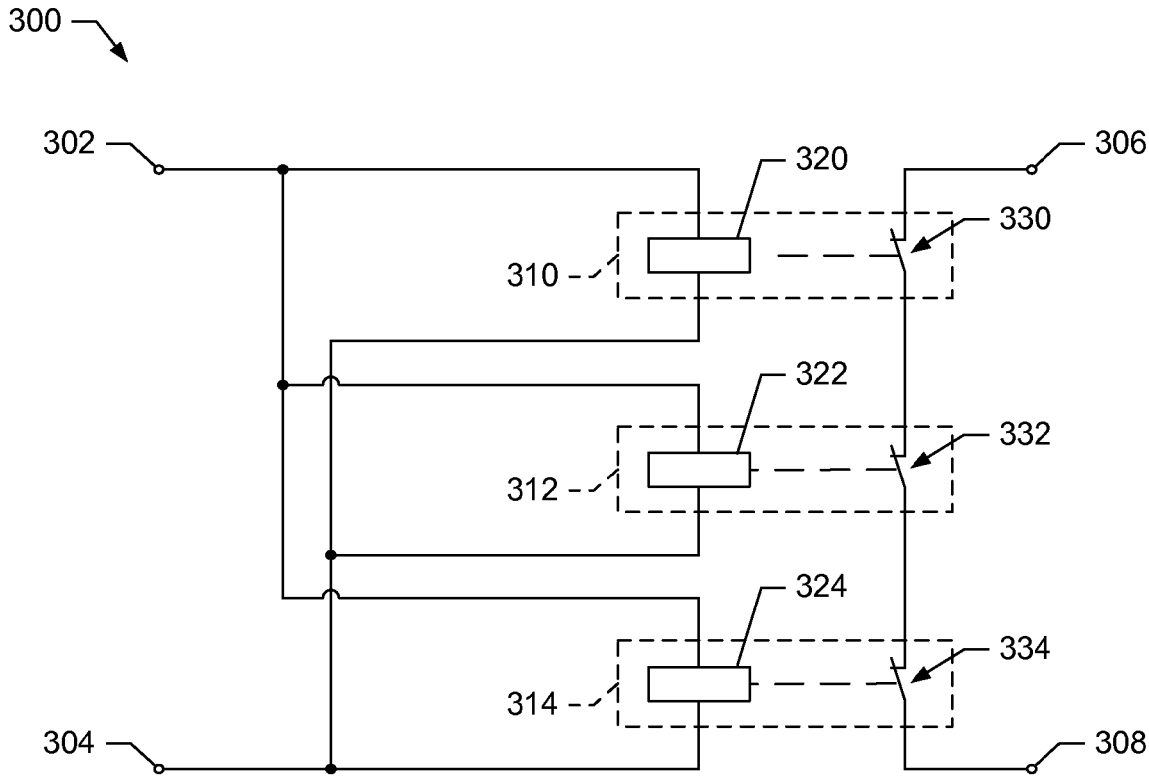
FIG. 3 (PRIOR ART)
FIG. 3 is a schematic of a known safety relay configuration.

FIG. 3 is a schematic of a known safety relay 300 that may be used to implement the example relay module 204 of FIG. 2. The example safety relay 300 includes a first relay 310, a second relay 312, and a third relay 314 configured in parallel between a first node 302 and a second node 304. The relays 310, 312, and 314 include respective relay coils 320, 322, and 324, which are electromagnetically coupled to respective relay contacts 330, 332, and 334. The relay contacts 330-334 are connected in series between a third node 306 and a fourth node 308. In this known configuration, the example safety relay 300 provides some fault tolerance because an electric potential between the first node 302 and the second node 304 energizes the three parallel relay coils 320 and 324, any one of which can open the electrical path between the third node 306 and the fourth node 308. For example, if the relay contact 330 is inoperable (e.g., welded such that the relay contacts are fused to a closed state), either or both of the remaining relay contacts 332 or 334 may still be operable to open the electrical path between the third node 306 and the fourth node 308.

However, the operation of each of the relay contacts 330-334 is not independently testable because the relays 310-314 are directly coupled in parallel between the first node 302 and the second node 304. More particularly, all of the relay contacts 330-334 are responsive to the same signal that is applied to all of the relay coils 320-324 at the same time. As a result, if the first relay contact 330 becomes inoperable (e.g., welds, fuses, melts, etc.) and the second and third relays 322 and 324 remain operable, the electrical path between the first and second nodes 306 and 308 will still open despite the welded relay contact 330. Therefore, the example safety relay 300 is not fully testable because testing cannot readily identify a reduction in hardware fault tolerance, such as one or two inoperable relay contacts.

Figure 4:
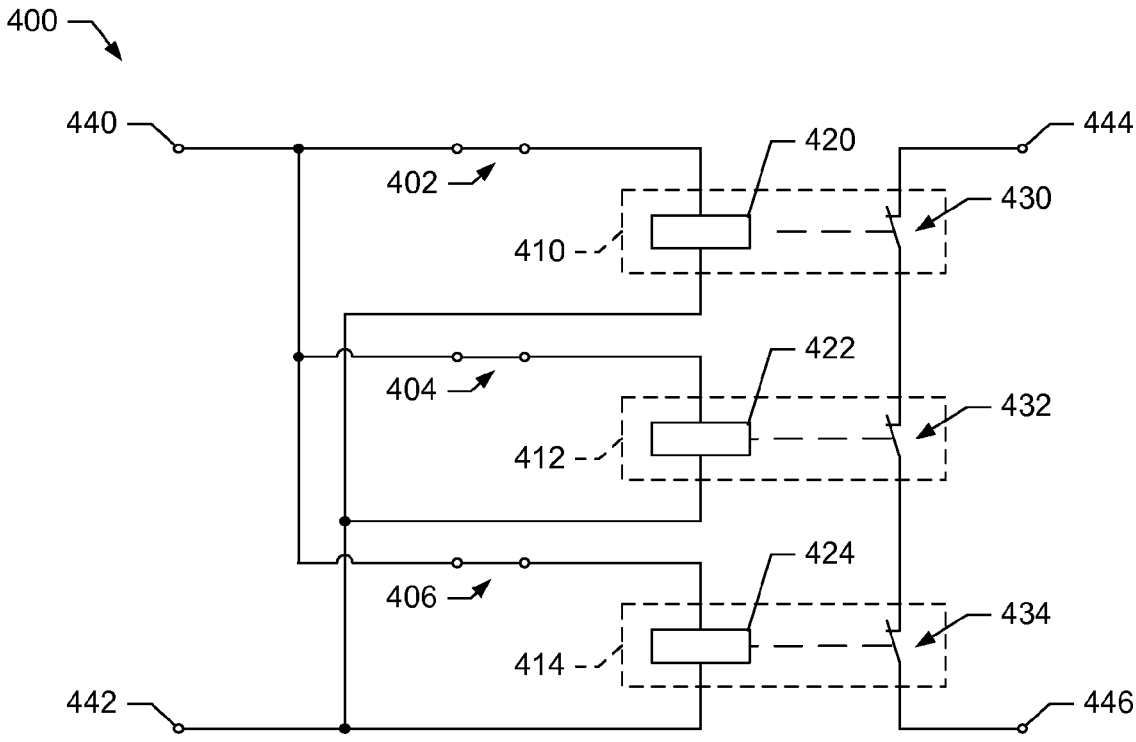
FIG. 4 is a schematic of an example safety relay having independently testable relay contacts.

FIG. 4 is an example safety relay 400 having independently testable relay contacts that may be used to implement the relay module 204 of FIG. 2. The example safety relay 400 includes switches 402, 404, and 406 that are connected in parallel between a first node 440 and a second node 442. The first and second nodes 440 and 442 may be respectively coupled to a controller or logic solver (e.g., via the hardwired connector(s) 210 of FIG. 2). Also, the example safety relay 400 includes relays 410, 412, and 414 respectively connected in series with corresponding ones of the switches 402, 404, and 406. Each of the relays 410-414 respectively includes one of the relay coils 420, 422, and 424, operatively or electromagnetically coupled to one relay contact of the three relay contacts 430, 432, and 434. The relay contacts 430, 432, and 434 are connected in series between a third node 444 and a fourth node 446. The third and fourth nodes 444 and 446 may respectively couple to the hardwired connectors 212 and 214 of FIG. 2.

The term "node" as used herein includes an electrical point within a circuit and may, for example, correspond to an electrical connection or connector, an electrical termination point, a point at which an electrical measurement can be made, etc. Additionally, while the example safety relays 400 and described in connection with FIG. 4 above and FIGS. 5 and 6 below depict the use of three relays and contacts, safety relays having two relays or more than three relays could be used instead to achieve similar results.

The example safety relay 400 is fault-tolerant such that when an electric potential is removed from the first and second nodes 440 and 442 and the switches 402-406 are closed, any one of the three energized relay coils 420-424 can open its respective one of the relay contacts 430-434 to open the electrical path between the third and fourth nodes 444 and 446. Also, the example safety relay 400 is fully testable because during a field test, as described below, the switches 402-406 can be used to independently operate or control the relay contacts 430-434 to determine, for example, if any one of the three relay contacts 430-434 is inoperable (e.g., welded contacts). The example switches 402-406 may be implemented to be manually operated by a human operator or, as described below, by a programmable logic controller ("PLC"), a personal computer similar to the example processor system 1200 shown in FIG. 12 below, single or multiprocessor workstations, etc.

Figure 5:
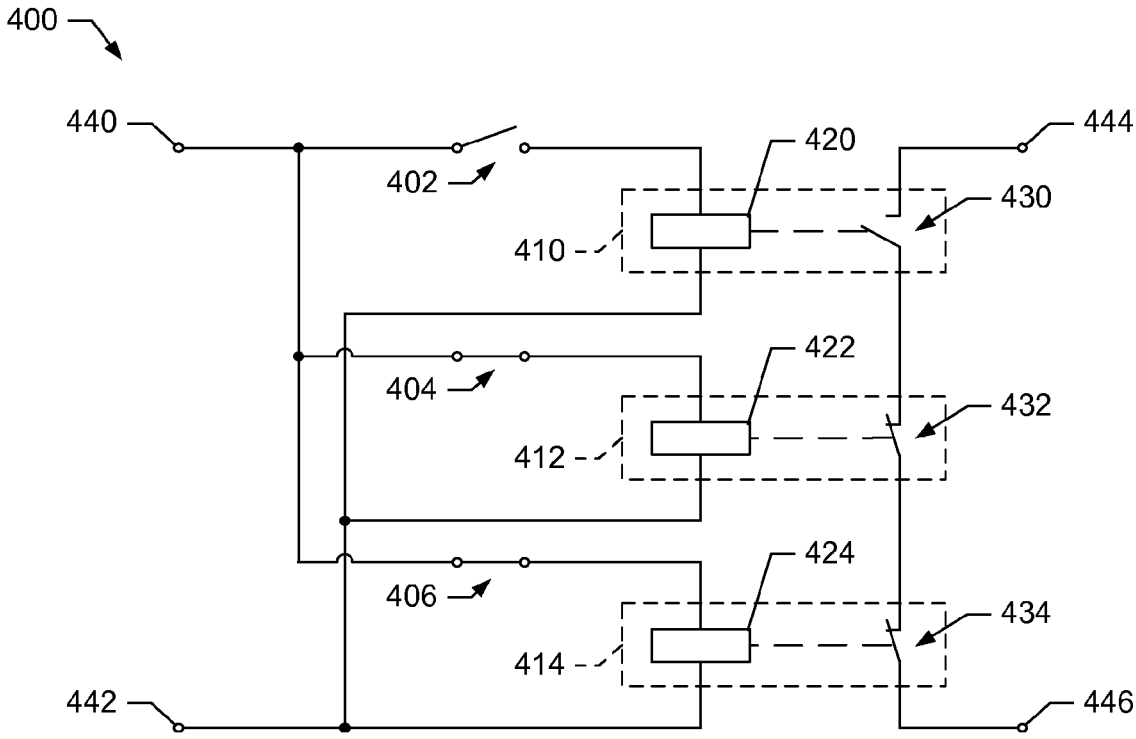
FIG. 5 is a schematic of the example safety relay of FIG. 4 in a testing state in which an operable relay contact is opened.

FIG. 5 is a schematic of the example safety relay 400 of FIG. 4 in a testing state in which an operable relay contact is open. More specifically, with the switch 402 opened and an electric potential applied across the first and second nodes 440 and 442 to energize the second and third relay coils 422 and 424, the second and third relay contacts 432 and 434 are closed. In this state, the first relay contact 430 is open or interrupts the electrical path between the third and fourth nodes 444 and 446, thereby causing the electric potential across the third and fourth nodes 444 and 446 to increase or to be substantially non-zero. In this instance, because the electric potential is substantially non-zero, the test indicates that the first relay contact 430 is operable (e.g., that the contact 430 of FIG. 5 is not welded). Similarly, the second and third relay contacts 432 and 434 can be tested by opening the respective switches 404 and 406. Thus, the availability of the example safety relay 400 to open or interrupt the electrical path between the third and fourth nodes 422 and 424 is testable by observing the operability of each of the relay contacts 430, 432, and 434.

Figure 6:
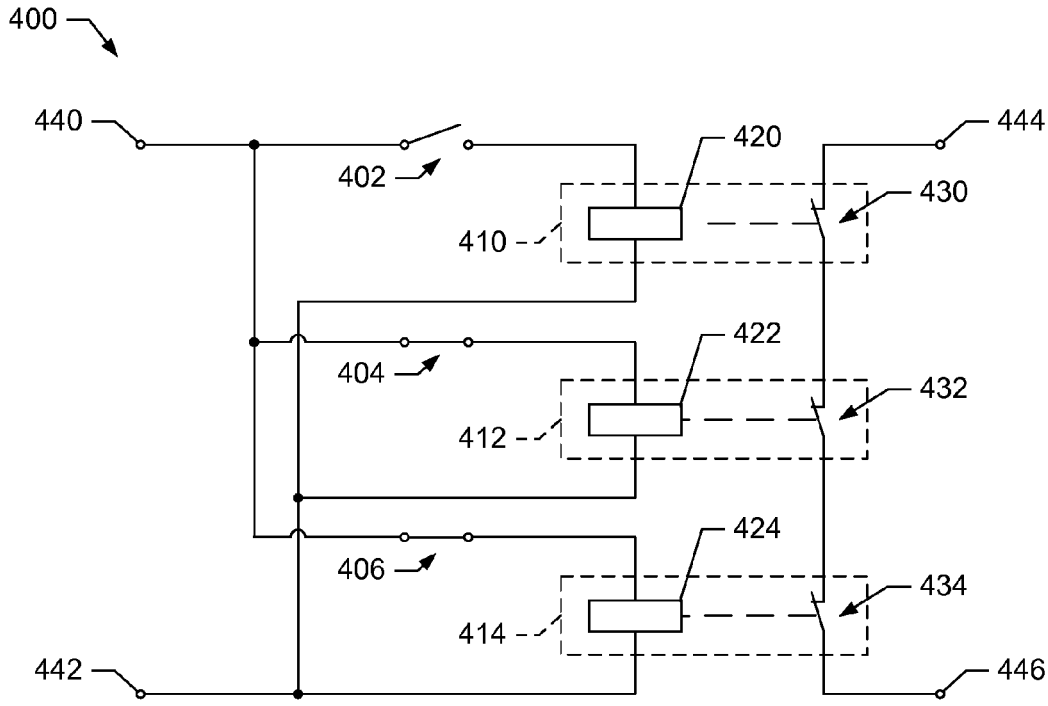
FIG. 6 is a schematic of the example safety relay of FIG. 4 in a testing state in which an inoperable relay contact fails to open.

FIG. 6 is a schematic of the example safety relay 400 of FIG. 4 in a testing state in which an inoperable relay contact fails to open. More specifically, with the switch 402 opened and an electric potential applied across the first and second nodes 440 and 442 to energize the second and third relay coils 422 and 424, the second and third relay contacts 432 and 434 are closed. In this state, the first relay contact 430 should open the electrical path between the third and fourth nodes 444 and 446. However, the first relay contact 430 is inoperable (e.g., welded) and, thus, fails to open. Consequently, the electric potential across the third and fourth nodes 444 and 446 will be substantially zero because the path across the third and fourth nodes 444 and 446 is not opened or otherwise interrupted by the first relay contact 430. Similarly, each of the switches 404 and 406 can be independently opened to de-energize its respective one of the relay coils 442 and 424 to open its respective one of the relay contacts 432 and 434. In the example testing state of FIG. 6, the impaired availability of the example safety relay 400 to redundantly open or interrupt the electrical path between the third and fourth nodes 422 and 424 is observable. More particularly, the example testing state of FIG. 6 specifically identifies the inoperability (e.g., welding) of the relay contact 430.

Figure 7:
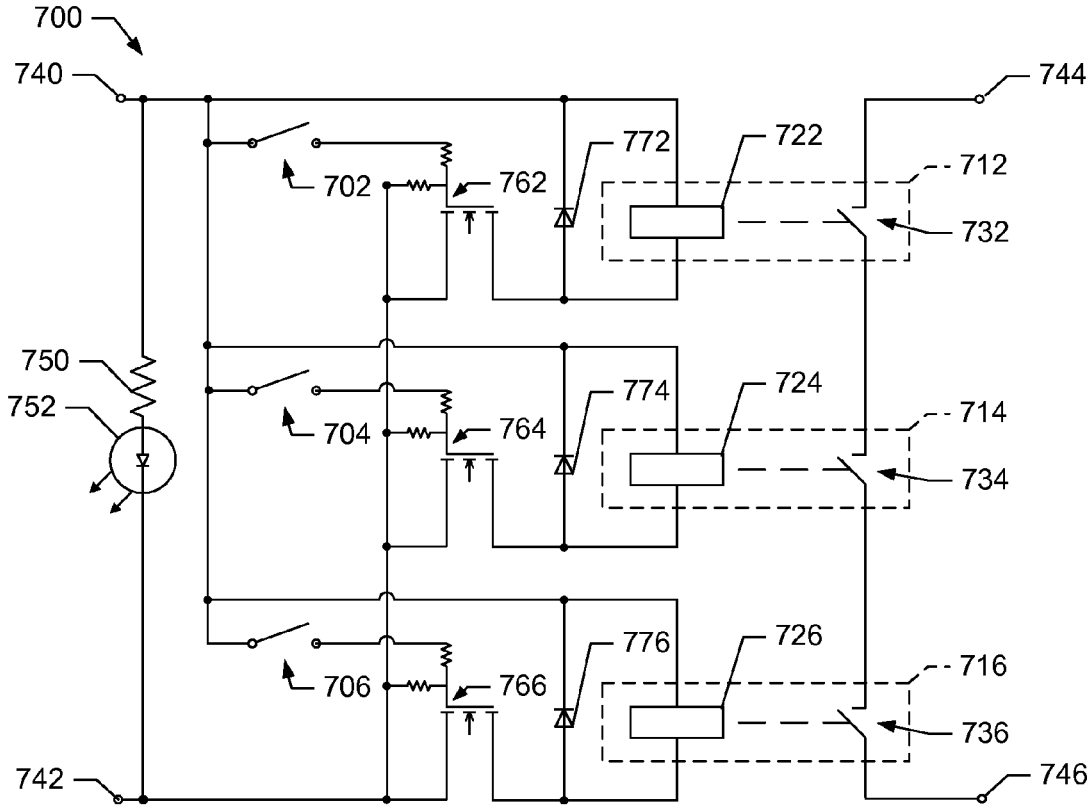
FIG. 7 is a schematic of a second example safety relay having independently testable contacts.

FIG. 7 is a schematic of a second example safety relay 700 having independently testable relay contacts that may be used to implement the relay module 204 of FIG. 2. The example safety relay 700 includes switches 702, 704, and 706 that are connected in parallel between a first node 740 and a second node 742. The first and second nodes 740 and 742 may respectively couple to the hardwired connector(s) 210 of FIG. 2. The example safety relay 700 also includes relays 712, 714, and 716 that are connected in series with respective ones of the switches 702-706. The relays 712-716 include respective relay coils 722, 724, and 726 that are electromagnetically coupled to respective ones of the contacts 732, 734, and 736, which are connected in series between a third node 744 and a fourth node 746. The third and fourth nodes 744 and 746 may respectively couple to the hardwired connectors 212 and 214 of FIG. 2.

The example safety relay 700 further includes a resistor 750 and a light-emitting diode ("LED") 752 to emit light if the electric potential between the first and second node 740 and 742 is large enough to bias the LED. The LED 750 provides an indicating light to a human operator that the example safety relay 700 is powered. Additionally, the example safety relay 700 includes transistors 762, 764, and 766 that connect to respective ones of the switches 702-706. Also, diodes 772, 774, and 776 are coupled to transistors 762-766 and the relay coils 722-726. In operation, the diodes 772-776 limit the voltage across and shunt the sudden change of current flow through the relay coils 722-726 that may result when the electric potential applied across the relay coils 722-726 rapidly changes. For example, when the electric potential across the first and second nodes 740 and 742 changes from a positive to a substantially zero voltage, a resultant magnetic field from the relay coils 722-726 may produce substantial voltage transients (e.g., flyback).

The transistors 762-766 may be configured to provide high-input impedance to substantially limit the current flowing through the switches 702-706 and provide a solid-state device to switch the current to the relay coils 722-726. Thus, in a hazardous environment, which may benefit from and/or require certified or explosion-proof components, the example safety relay 700 is configured to enable switching without creating an igniting spark or arc. For instance, the example safety relay 700 may be configured within petrochemical, chemical, and pharmaceutical environments that contain explosive gases or dust during normal operations and/or abnormal circumstances. For example, when switch 702 is open and the transistor 762 is switched off (e.g., a controlling voltage is applied across the gate and source to increase conductivity between the drain and source), the current through and the electric potential across the switch 702 is substantially zero. Thus, when the switch 702 closes, substantially zero discharge occurs across the contacts of switch 702 (e.g., substantially zero sparking, substantially zero arcing, etc.). Similarly, when the switch 702 is closed and the transistor 762 is switched off, current through and the electric potential across the switch 702 is substantially zero. Thus, when switch 702 opens, substantially zero discharge occurs across the contacts of switch 702 (e.g., substantially zero sparking, substantially zero arcing, etc.).

Additionally, the transistors 762-766 may be configured to provide high-output impedance substantially constant current sources to drive the relay coils 722-726 from a relatively small electric potential across the first and second nodes 740 and 742. In such a configuration, the transistors 762-766 provide more immediate switching capabilities and prevent the relay coils from entering saturation. For example, when the transistor 762 is switched on (e.g., a controlling voltage is applied across the gate and source to increase conductivity between the drain and source), the current to the relay coil 722 is relatively constant and, subsequently, the magnetic field across the relay coil 722 is relatively constant. When the transistor 762 is switched off (e.g., a controlling voltage is removed from the gate and source to decrease conductivity between the drain and source), the current to the relay coil 722 ceases quickly and, subsequently, the magnetic field across the relay coil 722 collapses rapidly.

Figure 8:
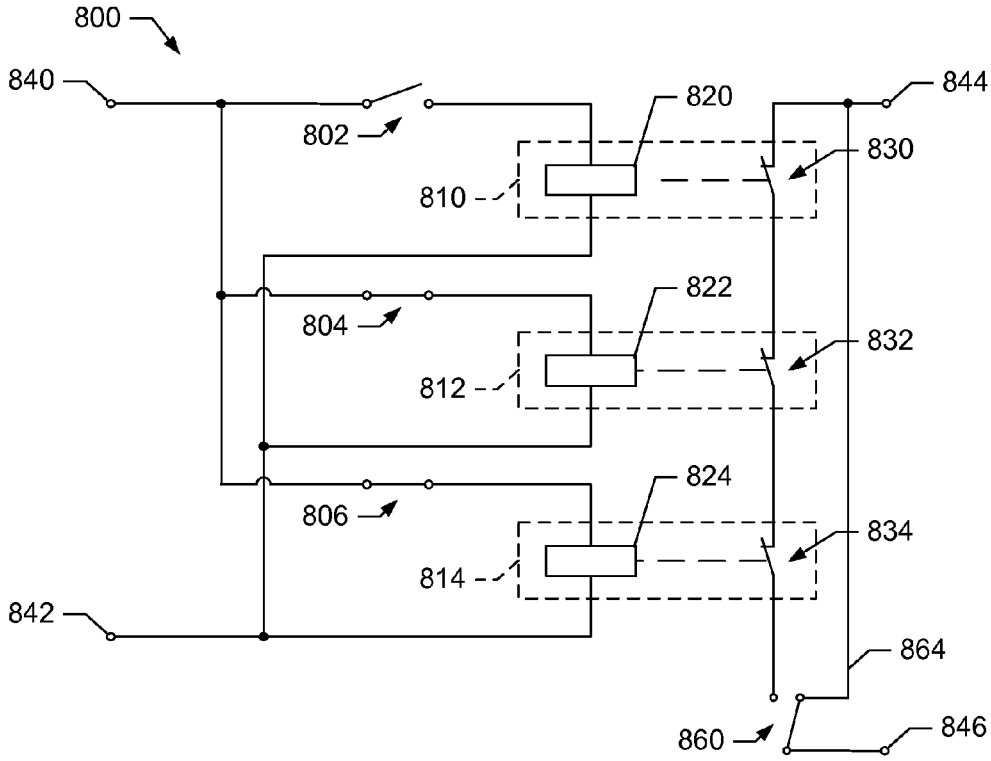
FIG. 8 is a schematic of a third example safety relay having independently testable contacts.

FIG. 8 is a schematic of a third example safety relay 800 having independently testable relay contacts that may be used to implement the relay module 204 of FIG. 2. The example safety relay 800 includes switches 802, 804, and 806 that are connected in parallel between a first node 840 and a second node 842. The first and second nodes 840 and 842 may respectively couple to the hardwired connector(s) 210 of FIG. 2. The example safety relay 800 also includes respective relays 810, 812, and 814 connected in series with respective ones of the switches 802-806. The relays 810-814 include respective relay coils 820, 822, and 824, which are electromagnetically coupled to respective relay contacts 830, 832, and 834. The relay contacts 830-834 are connected in series between a third node 844 and a fourth node 846. Additionally, the example relay 800 includes a bypass switch 860 that may be used to decouple the relay contacts 830-834 from the third and fourth nodes 844 and 846 and provide a second or alternative electrical path between the third and fourth nodes 844 and 846 via a bypass circuit 864. While the bypass switch 860 is implemented in the example FIG. 8 to decouple the relay contacts 830-834 from the fourth node 846, the bypass switch 860 may alternatively be implemented to decouple the relay contacts 830-834 from the third node 844.

To test the example safety relay 800, a human operator can manually operate the bypass switch 860. As shown in FIG. 8, the example bypass switch 860 provides a second electrical path via the bypass circuit 864, which allows an example field device (e.g., the field actuator 208 of FIG. 2) to continue to receive power via the third and fourth nodes 844 and 846 (e.g., the hardwired connectors 212 and 214 of FIG. 2) during testing of the contacts 830-834. In particular, the example bypass switch 860 enables a human operator to test the relay contacts 830-834 using the switches 802-806, as described above in connection with FIGS. 4-6, without opening the electrical path between the third and fourth nodes 844 and 846 and subsequently disabling the field device(s) coupled to the nodes 844 and 846.

The example bypass switch 860 may be implemented using, for example, a manual spring-loaded switch or a timed switch, which ensures that a human operator cannot leave the bypass switch 860 in an incorrect position (e.g., the relay contacts 830-834 decoupled from the fourth node 846). Additionally, the example bypass switch 860 may use a force-guided mechanism, so that a human operator cannot test the safety relay 800 if the bypass switch 860 is inoperable (e.g., the contacts of the bypass switch 860 are welded).

Figure 9:
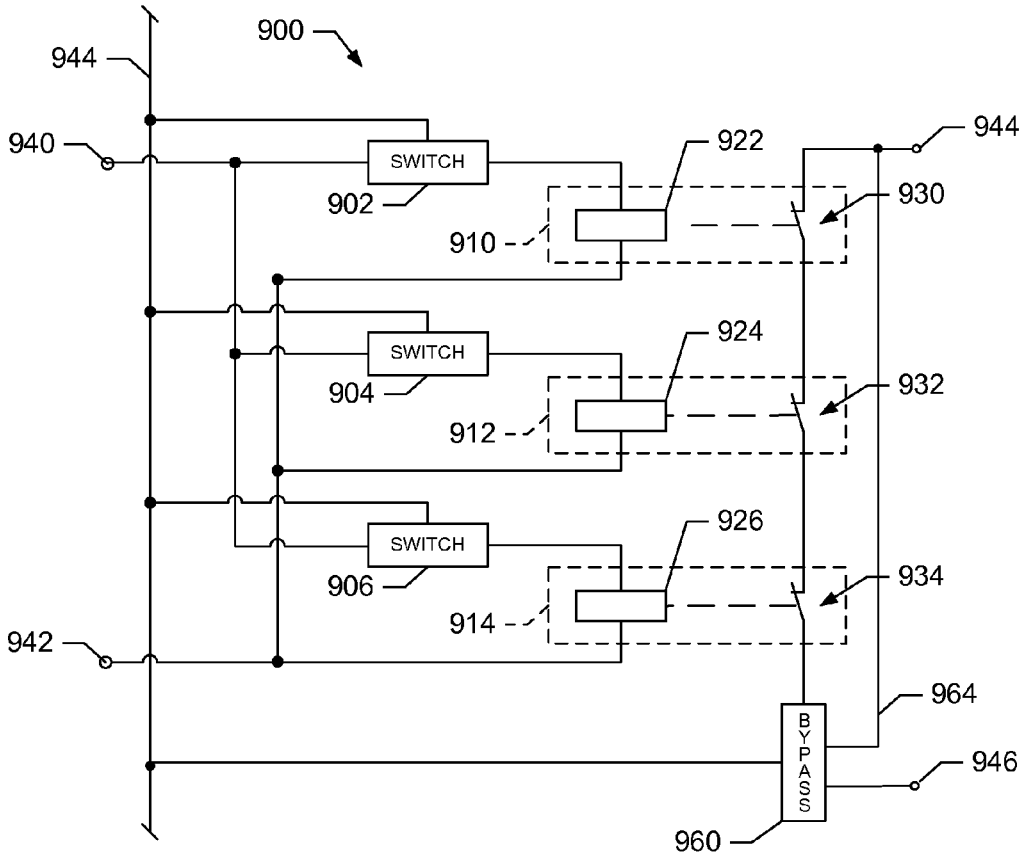
FIG. 9 is a schematic of a fourth example safety relay safety relay having independently testable contacts.

FIG. 9 is an example safety relay 900 having independently testable relay contacts that may be used to implement the relay module 150 of FIG. 1. The example safety relay 900 includes switches 902, 904, and 906 that are connected in parallel between a first node 940 and a second node 942. The example safety relay 900 also includes relays 910, 912, and 914 connected in series to respective ones of the switches 902-906. The relays 910-914 include respective relay coils 922, 924, and 926, which are electromagnetically coupled to respective ones of the relay contacts 930, 932, and 934. The relay contacts 930-934 are connected in series between a third node 944 and a fourth node 946. Additionally, the example relay 900 includes a bypass switch 960 that may be used to decouple the relay contacts 930-934 from the fourth node 946 and to provide a second or alternative electrical path between the third and fourth nodes 944 and 946 via a bypass circuit 964.

Also, in the example safety relay 900, the switches 902, 904, and 906 and the bypass switch 960 are coupled to a data bus 944 such as, for example, the data bus 132 of FIG. 1. In response to communications or signals conveyed via the data bus 944, the example switches 902-906 and/or the bypass switch 960 may open and/or close. The communications or signals on the data bus 944 may be sent, for example, from a controller (e.g., controller 120 of FIG. 1), a logic solver (e.g., logic solvers 160 and 162 of FIG. 1), or any other device enabled to communicate via a data bus (e.g., programmable logic controllers, personal computers similar to the example processor system 1200 shown in FIG. 12 below, single or multi-processor workstations, etc.) Using such signals to communicate with the example safety relay 900 and the aforementioned devices, a human operator can remotely test the example safety relay 900 using a process similar to that described above in connection with FIGS. 4-6. Also using such signals, a human operator can remotely test the position of the bypass switch 960 of the example safety relay 900. For example, a human operator can determine whether the relay contacts 930-934 are decoupled from the electrical path between the third and fourth nodes 944 and 946. Alternatively or additionally, the testing process may be automatically performed as described below in connection with FIGS. 10 and 11.

Figure 10:
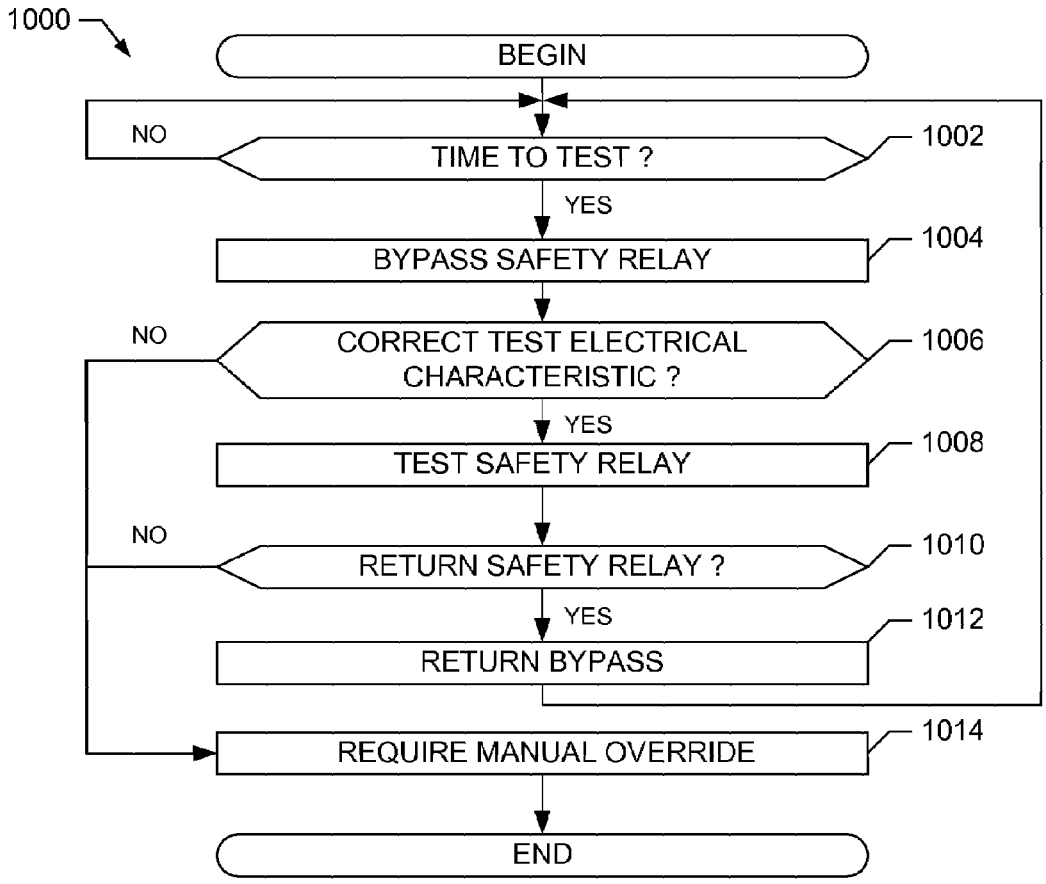
FIG. 10 is a flow chart depicting an example method to test an example safety relay.

FIG. 10 is a flowchart depicting an example method to test an example safety relay such as, for example, the example safety relays having independently testable contacts described herein. The operations described in connection with the methods depicted in FIGS. 10 and 11, may be implemented using machine readable instructions, code, software, etc., which may be stored and accessed on a computer readable medium. Such a computer readable medium includes, but is not limited to optical storage devices, magnetic storage devices, non-volatile solid-state memory, and volatile solid-state memory. Further, some or all of the operations may be performed manually and/or the order of the operations may be changed and/or some of the operations may be modified or eliminated. Similarly, the some or all of the operations of each block can be performed iteratively. The operations depicted in FIGS. 10 and 11 may be performed by the example controller 120, the example logic solvers 160 and 162, the example operator station 122, and/or the application stations 124 and 126 of FIG. 1 to test the example relay modules 150-152 of FIG. 1.

Turing in detail to FIG. 10, the example process 1000 begins at a loop that determines whether the process 1000 should proceed to test a safety relay (e.g., the example safety relay 900 of FIG. 9) or continue to wait (block 1002). After determining that it is time to test a safety relay and exiting the loop at block 1002, the example process 1000 bypasses the safety relay (e.g., connects node 946 and bypass circuit 964 with the bypass switch 960 of FIG. 9) (block 1004). After the safety relay is bypassed (block 1004), the example process 1000 tests an electrical characteristic associated with the relay contacts (e.g., an electric current, an electric potential, resistance, etc. associated with the relay contacts 932-936 of FIG. 9) that indicates the relay contacts are not bypassed (block 1006). If such an electrical characteristic is determined (e.g., a substantially non-zero electric current or an electric current greater than a predetermined value flowing through the relay contacts 932-936 of FIG. 9) (block 1006), the example process 1000 requires a manual override (block 1014). The manual override (block 1014) may provide a signal to request a human operator intervention (e.g., an LED, a warning on a graphical-user-interface, etc.) and start a timer to automatically shutdown a process control system (e.g., the process control system 10) in a predetermined manner.

If the electrical characteristic is determined (e.g., a substantially zero electric current or an electric current less than a predetermined value flowing through the relay contacts 932-936 of FIG. 9) that indicates the relay contacts are bypassed (block 1012), the example process 1000 tests the safety relay (block 1008). After the safety relay is tested (block 1008), the example process 1000 determines whether to return the bypass to its original position to reactivate the safety relay (block 1010). If, for example, a specified number of relay contacts are determined to be inoperable (e.g., welded contacts or otherwise faulted) (block 1008), the example process 1000 requires a manual override (block 1014), as discussed above. Alternatively, the example process 1000 returns the safety relay to an active state (e.g., connects node 946 and relay contacts 930-934 with the bypass switch 960 of FIG. 9) (block 1012). After the bypass is returned and the safety relay is active, the example process 1000 waits for another test cycle (block 1002).

Figure 11:
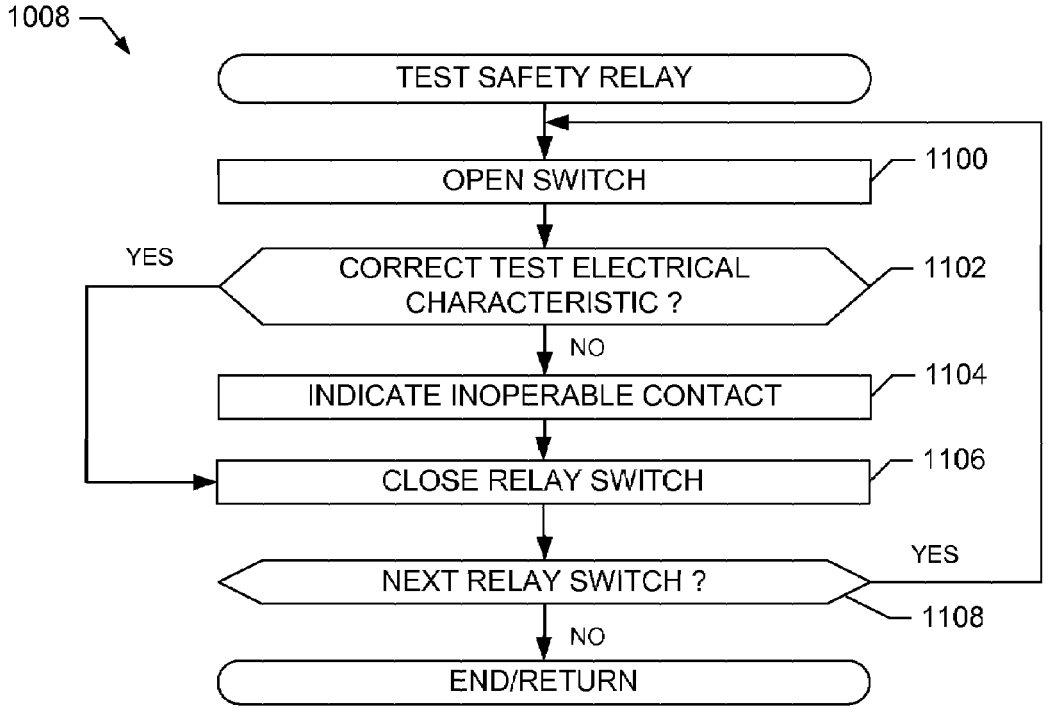
FIG. 11 is a flow chart depicting an example method that may be used to implement the test safety relay process depicted in FIG. 10.

FIG. 11 is a flowchart depicting an example method that may be used to implement the test safety relay process 1008 depicted in FIG. 10. As discussed above, the example safety relay testing process 1008 of FIG. 11 may be used, for example, to test the example relay modules 150-152 of FIG. 1. The example safety relay testing process 1008 of FIG. 11 begins by opening a switch on the safety relay (e.g., one of the switches 902-906 of FIG. 9), which de-energizes a relay coil on the safety relay (e.g., one of the relay coils 922-926 of FIG. 9) (block 1100). After the switch is opened on the safety relay (block 1100), the example safety relay testing process 1008 of FIG. 11 tests an electrical characteristic associated with the relay contacts on the safety relay (e.g., an electric potential, a resistance, etc. associated with the relay contacts 932-936 of FIG. 9) (block 1102). If the example safety relay testing process 1008 of FIG. 11 determines an electrical characteristic (e.g., a substantially zero electric potential or an electric potential less than a predetermined value across the relay contacts 932-936 of FIG. 9) that indicates a relay contact associated with the opened switch and de-energized relay coil is inoperable (e.g., a welded contact) (block 1102), the example safety relay testing process 1008 indicates the relay contact associated with the opened switch and de-energized relay coil as inoperable (block 1004). The example safety relay testing process 1008 may indicate the inoperable contact by, for example, signaling to a human operator (e.g., using an LED, a warning on a graphical-user-interface, etc.) and increasing a counter variable that adds the number of inoperable relay contacts.

If the example safety relay testing process 1008 of FIG. 11 determines an electrical characteristic (e.g., a substantially non-zero electric potential, an electric potential greater than a predetermined value, etc.) that indicates the relay contact associated with the opened switch and de-energized relay coil did operate (block 1102) or, after a relay contact is indicated as inoperable (block 1104), the example safety relay testing process 1008 of FIG. 11 closes the switch that was opened in block 1100 (block 1106). After the switch is closed (block 1106), the example safety relay testing process 1008 of FIG. 11 determines if any additional switches on the safety relay requires testing by opening a respective switch (block 1108). If an additional switch on the safety relay requires testing, the example safety relay testing process 1008 of FIG. 11 opens the next switch (block 1108). Alternatively, if no additional switch on the safety relay requires testing, the example safety relay testing process 1008 of FIG. 11 ends and returns any results to the example process 1000 of FIG. 10.

Figure 12:
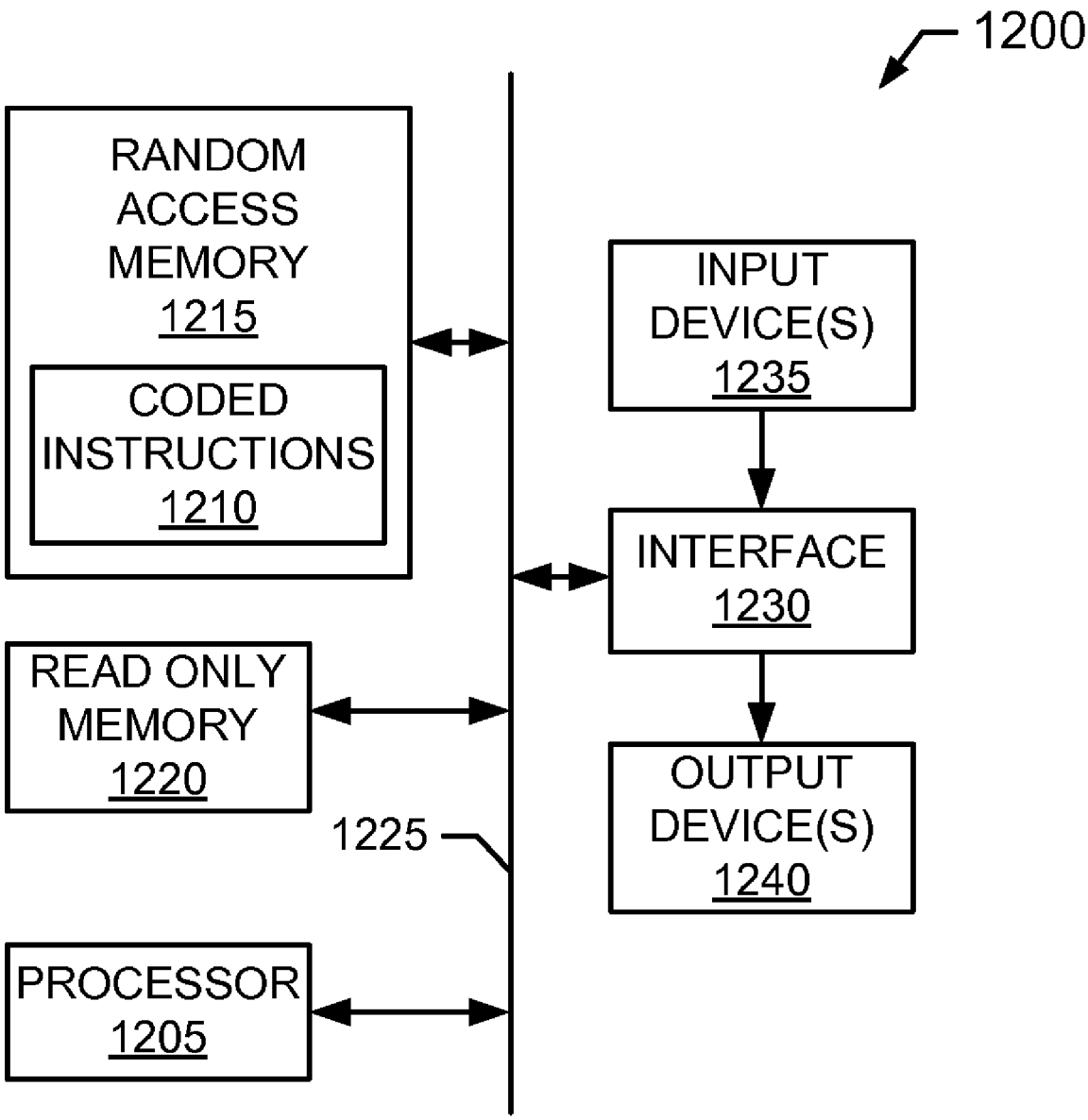
FIG. 12 is a schematic illustration of an example processing system that may be used to implement the methods and apparatus described herein.

FIG. 12 is a schematic diagram of an example processor platform 1200 that may be used and/or programmed to implement the example controller 120, the example logic solvers 160 and 162, the example operator station 122, and/or the application stations 124 and 126 of FIG. 1. For example, the processor platform 1200 can be implemented by one or more general purpose single-thread and/or multi-threaded processors, cores, microcontrollers, etc. The processor platform 1200 may also be implemented by one or more computing devices that contain any of a variety of concurrently-executing single-thread and/or multi-threaded processors, cores, microcontrollers, etc.

The processor platform 1200 of the example of FIG. 12 includes at least one general purpose programmable processor 1205. The processor 1205 executes coded instructions 1210 present in main memory of the processor 1205 (e.g., within a random-access memory (RAM) 1215). The coded instructions 1210 may be used to implement the operations represented by the example processes of FIGS. 10 and 11. The processor 1205 may be any type of processing unit, such as a processor core, processor and/or microcontroller. The processor 1205 is in communication with the main memory (including a read-only memory (ROM) 1220 and the RAM 1215) via a bus 1225. The RAM 1215 may be implemented by dynamic RAM (DRAM), Synchronous DRAM (SDRAM), and/or any other type of RAM device, and ROM may be implemented by flash memory and/or any other desired type of memory device. Access to the memory 1215 and 1220 may be controlled by a memory controller (not shown).

The processor platform 1200 also includes an interface circuit 1230. The interface circuit 1230 may be implemented by any type of interface standard, such as an external memory interface, serial port, general purpose input/output, etc. One or more input devices 1235 and one or more output devices 1240 are connected to the interface circuit 1230.

At least some of the above described example methods and/or apparatus are implemented by one or more software and/or firmware programs running on a computer processor. However, dedicated hardware implementations including, but not limited to, application specific integrated circuits, programmable logic arrays and other hardware devices can likewise be constructed to implement some or all of the example methods and/or apparatus described herein, either in whole or in part. Furthermore, alternative software implementations including, but not limited to, distributed processing or component/object distributed processing, parallel processing, or virtual machine processing can also be constructed to implement the example methods and/or apparatus described herein.

It should also be noted that the example software and/or firmware implementations described herein are optionally stored on a tangible storage medium, such as: a magnetic medium (e.g., a magnetic disk or tape); a magneto-optical or optical medium such as an optical disk; or a solid state medium such as a memory card or other package that houses one or more read-only (non-volatile) memories, random access memories, or other re-writable (volatile) memories; or a signal containing computer instructions. A digital file attached to e-mail or other information archive or set of archives is considered a distribution medium equivalent to a tangible storage medium. Accordingly, the example software and/or firmware described herein can be stored on a tangible storage medium or distribution medium such as those described above or successor storage media.

To the extent the above specification describes example components and functions with reference to particular standards and protocols, it is understood that the scope of this patent is not limited to such standards and protocols. Such standards are periodically superseded by faster or more efficient equivalents having the same general functionality. Accordingly, replacement standards and protocols having the same functions are equivalents which are contemplated by this patent and are intended to be included within the scope of the accompanying claims.

Additionally, although this patent discloses example systems including software or firmware executed on hardware, it should be noted that such systems are merely illustrative and should not be considered as limiting. For example, it is contemplated that any or all of these hardware and software components could be embodied exclusively in hardware, exclusively in software, exclusively in firmware or in some combination of hardware, firmware and/or software. Accordingly, while the above specification described example systems, methods and articles of manufacture, persons of ordinary skill in the art will readily appreciate that the examples are not the only way to implement such systems, methods and articles of manufacture. Therefore, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A safety relay comprising:

a first relay including a first relay contact and a first relay coil to change the state of the first relay contact when the first relay coil is energized;

a first switch coupled in series with the first relay coil;

a second relay including a second relay contact and a second relay coil to change the state of the second relay contact when the second relay coil is energized;

a second switch coupled in series with the second coil, wherein the first switch and the first relay coil are coupled in parallel with the second switch and the second relay coil between a first node and a second node, and wherein the first relay contact and the second relay contact are coupled in series between a third node and a fourth node;

a third relay including a third relay contact and a third relay coil to change the state of the third relay contact when the third relay coil is energized; and a third switch coupled in series with the third coil, wherein the third switch and the third relay coil are coupled in parallel with the first switch and the first relay coil between the first node and the second node, and wherein the third relay contact is coupled in series with the first relay contact and the second relay contact between the third node and the fourth node.

2. A safety relay as defined in claim, 1 further comprising a light-emitting diode coupled between the first node and second node.

3. A safety relay as defined in claim, 1 further comprising a bypass switch to decouple the first relay contact and the second relay contact from at least one of the third node or the fourth node and to provide an electrical path between the third node and the fourth node.

4. A safety relay as defined in claim 3, wherein the bypass switch is configured to be responsive to a signal from a controller to decouple the first relay contact and the second relay contact from the at least one of the third node or the fourth node and to provide the electrical path between the third node and the fourth node.

5. A safety relay as defined in claim 3, wherein the bypass switch is configured to, at a first time, decouple the first relay contact and the second relay contact from the at least one of the third node or the fourth node and automatically provide the electrical path between the third node and fourth node and, at a second time, automatically open the electrical path between the third node and fourth node.

6. A safety relay as defined in claim 3, wherein the bypass switch is configured to, at a first time, decouple the first relay contact and the second relay contact from at least one of the third node or the fourth node and automatically provide the electrical path between the third node and fourth node and, at a second time, automatically open the electrical path and reconnect the first relay contact and the second relay contact between the third node and the fourth node.

7. A safety relay as defined in claim 3, wherein the bypass switch is a force-guided switch.

8. A safety relay as defined in claim 3, wherein the bypass switch is configured to be responsive to a signal from a controller to automatically open or close.

9. A safety relay as defined in claim, 1, wherein the first switch is configured to be responsive to a signal from a controller to automatically open or close.

10. A safety relay as defined in claim, 1, wherein the third node and the fourth node are configured to provide contacts to measure an electrical characteristic.

11. A safety relay as defined in claim 10, wherein the contacts are configured to enable a controller to automatically measure the electrical characteristic.

12. A safety relay as defined in claim 10, wherein the electrical characteristic is at least one of an electric potential, an electric current, an impedance, or a resistance.

13. A safety relay comprising:

a first relay including a first relay contact and a first relay coil to change the state of the first relay contact when the first relay coil is energized;

a first switch coupled in series with the first relay coil;

a second relay including a second relay contact and a second relay coil to change the state of the second relay contact when the second relay coil is energized;

a second switch coupled in series with the second coil, wherein the first switch and the first relay coil are coupled in parallel with the second switch and the second relay coil between a first node and a second node, and wherein the first relay contact and the second relay contact are coupled in series between a third node and a fourth node;

a diode coupled in parallel with the first relay coil; and a transistor coupled between the diode and the first switch.

14. A safety relay comprising:

a plurality of relay coils coupled in parallel; and a plurality of series coupled relay contacts associated with the relay coils, wherein the operation of each of the relay contacts is testable in response to a signal applied to the relay coils; and a bypass switch selectively coupled in series with the plurality of relay contacts to decouple the plurality of relay contacts from an electrical path between a first and second node.

15. An apparatus as defined in claim 14, wherein the bypass switch is configured to be responsive to a signal from a controller to automatically open or close.

16. An apparatus comprising:

a plurality of relay coils, each of which is coupled to a first node via a respective one of a plurality of switches; and a plurality of relay contacts, each of which corresponds to a respective one of the plurality of relay coils, wherein the relay contacts are coupled in series and wherein each of the relay contacts is independently controllable by its respective one of the switches; and a plurality of transistors each of which is coupled in series with respective ones of the plurality of relay coils and switches.

17. An apparatus as defined in claim 16, further comprising a bypass switch to decouple the plurality of relay contacts from an electrical path.

18. An apparatus as defined in claim 17, wherein the bypass switch automatically provides a second electrical path.

19. An apparatus as defined in claim 17, wherein the bypass switch is configured to be responsive to a signal from a controller to automatically open or close.

20. An apparatus as defined in claim 17, wherein the bypass switch is configured to, at a first time, decouple the plurality of relay contacts from the electrical path and automatically provide a second electrical path and, at a second time, automatically open the second electrical path.

21. An apparatus as defined in claim 17, wherein the bypass switch is configured to measure an electrical characteristic.

22. An apparatus as defined in claim 21, wherein the electrical characteristic is at least one of an electric potential, an electric current, an impedance, or a resistance.

23. An apparatus as defined in claim 16, wherein at least one of the plurality of switches is configured to be responsive to a signal from a controller to automatically open or close.

24. An apparatus as defined in claim 16, wherein the series coupling of the relay contacts provides at least one electrical contact configured to enable a controller to measure an electrical characteristic.

25. An apparatus as defined in claim 16, wherein the contacts are configured to enable a controller to automatically measure the electrical characteristic.

26. An apparatus as defined in claim 16, wherein the electrical characteristic is at least one of an electric potential, an electric current, an impedance, or a resistance.

27. An apparatus as defined in claim 16 further comprising a plurality of diodes, each of which is coupled in parallel with respective ones of the plurality of relay coils and between respective ones of the plurality of transistors and relay coils.

* * * * *